US010246175B2

(12) United States Patent
Gai et al.

(10) Patent No.: US 10,246,175 B2
(45) Date of Patent: Apr. 2, 2019

(54) MARINE STEERING SYSTEM

(71) Applicant: ULTRAFLEX S.P.A., Casella (GE) (IT)

(72) Inventors: Marcella Gai, Busalla (IT); Andrea Milanese, Busalla (IT)

( * ) Notice: Subject to any disclaimer, the term of this patent is extended or adjusted under 35 U.S.C. 154(b) by 17 days.

(21) Appl. No.: 15/813,217

(22) Filed: Nov. 15, 2017

(65) Prior Publication Data

US 2018/0148150 A1 May 31, 2018

(30) Foreign Application Priority Data

Nov. 25, 2016 (IT) ..... 102016000119463

(51) Int. Cl.

| | |
|---|---|
| ***B63H 20/12*** | (2006.01) |
| ***B63H 25/52*** | (2006.01) |
| ***B63H 25/38*** | (2006.01) |
| ***B63H 25/22*** | (2006.01) |
| *B63H 20/00* | (2006.01) |

(52) U.S. Cl.

CPC ..... *B63H 25/52* (2013.01); *B63H 20/12* (2013.01); *B63H 25/22* (2013.01); *B63H 25/38* (2013.01); *B63H 21/265* (2013.01)

(58) Field of Classification Search

CPC ..... B63H 20/12; B63H 21/265; B63H 25/12; B63H 25/22

See application file for complete search history.

(56) References Cited

U.S. PATENT DOCUMENTS

| | | | | |
|---|---|---|---|---|
| 5,447,456 A * | 9/1995 | Nakayasu | ..... | B63H 21/265 114/150 |
| 5,471,907 A * | 12/1995 | Kobelt | ..... | B63H 25/16 114/114 |
| 6,524,147 B1 * | 2/2003 | Hundertmark | ..... | B63H 25/22 114/150 |
| 6,715,438 B1 | 4/2004 | Hundertmark | | |
| 7,325,507 B1 * | 2/2008 | Hundertmark | ..... | B63H 20/12 114/150 |

OTHER PUBLICATIONS

Italian Patent and Trademark Office, Search Report, dated Jul. 10, 2017.

* cited by examiner

*Primary Examiner* — Andrew Polay
(74) *Attorney, Agent, or Firm* — Themis Law

(57) ABSTRACT

A steering control system for a watercraft includes a device locking a steering tiller, which can be activated or deactivated for maintaining the tiller in, or moving it from, a predetermined angular position. The locking device includes a hydraulic cylinder having a rod fastened to the transom of the watercraft and a cylindrical body movable along the rod and connected to a steering arm of the motor or of the rudder member. A closed circuit, opened or closed by a valve, flows oil between the two chambers of the hydraulic cylinder and the locking device can be activated or deactivated by an actuator that opens or closes the valve. An interposition element between the steering tiller and a watercraft direction changing member is pivotably articulated to the tiller, and a member transforms the pivoting movement of the tiller relative to the interposition element into commands actuating the valve.

14 Claims, 8 Drawing Sheets

MARINE STEERING SYSTEM

FIELD OF THE INVENTION

The present invention relates to a steering control system for a watercraft comprising:

a pivoting steering tiller manually operated and operatively connected to a direction changing member acting on or into the water, such as a rudder plate or an outboard motor;

a device that locks the steering tiller in the steering position and that can be activated for maintaining the tiller in a predetermined pivoting position and deactivated for allowing the tiller to be moved in a pivoting position to carry out a change in the direction.

BACKGROUND OF THE INVENTION

Systems of this kind are known, for example, from U.S. Pat. No. 7,325,507. This document discloses that the steering action, namely, the force exerted on the steering tiller or steering arm of the motor through the tiller, is generated manually by the operator. The system exerts only an action locking the motor or the rudder and, therefore, the steering tiller when a change in direction is not desired, that is, a change of route. This is advantageous since with very powerful motors or with considerable surfaces of the rudder, the force that has to be exerted on the steering tiller is considerable and has to be maintained at all times to avoid a spontaneous change in orientation of the rudder plate or motor that, in combination with the hydrodynamic behavior of the watercraft and of the motor. also with reference to the propeller shape, tends to reach the highest possible pivoting angle of the tiller and consequently of the rudder or motor. A situation of this kind is very dangerous. above all when cruise speed is high.

Besides such passive system, the document U.S. Pat. No. 6,715,438 discloses an active system where the steering control exerted on the tiller is translated into a control pulse changing the tiller angle corresponding to an actuator changing the rotation of the motor or rudder. The document, as the actuator, discloses a hydraulic actuator of the type known in hydraulic steering systems used in watercrafts both for moving the plates or rudders with inboard motors, and for moving motors when they are outboard motors.

In both documents the control member is composed of an end handle portion of the steering tiller having a portion mounted to swing according to an axis substantially parallel to the axis of rotation of the motor or plate of a rudder, such portion driving a valve opening a circuit supplying a pressurized fluid to one or both of the chambers of an actuating cylinder.

Document U.S. Pat. No. 7,325,507 discloses a circuit connecting the two chambers of a double-acting cylinder. A valve is opened and is mechanically controlled by the pivoting movement of the end portion of the steering tiller relative to the part associated to the motor, allowing a fluid to pass from one to the other chamber of the cylinder and therefore releasing the pivoting movement of the tiller.

If the rotation of the tiller is carried out by a non-manual force, the pivoting movement of the end portion of the steering tiller activates, still by way of a valve control, the passage of a pressurized fluid from one pressurized reservoir to the chamber of the cylinder, which, therefore, is moved with respect to the rod and moves the arm of the motor connected to the cylinder.

By bringing back the handle in the rest condition, the valve closes the passage and the movement is locked until the end portion of the steering tiller is again operated.

The choice of using the end portion of the steering tiller as the control actuating the valve is determined by the need of containing the pivoting movement of such portion with respect to the tiller. It is a vain pivoting movement meaning that it does not cause a corresponding rotation of the steering member of the boat. If such pivoting movement is too wide, the operator has the annoying feeling of uselessly rotating the tiller before effectively operating a steering movement. For this reason the arm of the member actuating the valve is as shorter as possible. If it was placed in the distal portion of the tiller the arm would be equal to the length of the tiller resulting in a very marked pivoting movement of its proximal end. The arc of a circumference is equal to the size of the angle in radians by its radius.

On the other hand such solution requires the valve to be placed in a remote position with respect to the cylinder and therefore it requires the presence of pipes connecting the valve and cylinder that have an extension at least equal to the length of the tiller. Long pipes involve continuous bending stresses with a high wear level thereof.

Moreover, in known modern steering tillers the tendency is to mount on the steering tiller a plurality of controls for different maneuvering functions of the boat, such as for example controls for motor tilt, controls for motor trim, controls for the motor reverse gear, for controlling the number of revolutions of the motor and so on. This makes spaces available on the steering tiller more and more limited and it is more and more difficult to avoid interferences between the several mechanisms housed in the tiller body, resulting in potential dangerous situations or maintenance difficulties.

SUMMARY OF THE INVENTION

It is an object of the present invention to overcome at least partially the above discussed drawbacks by providing a more compact system and by having a limited overall size inside the steering tiller.

The invention achieves this object with a system such as described hereinbefore, where there are further provided an interposition element between the steering tiller and the watercraft direction changing member, the tiller being pivotably articulated to such interposition element about an axis that is vertical and substantially parallel to the steering axis, and a member converting the pivoting movement of the tiller with respect to the interposition element into commands actuating the valve.

In practice, the valve is mounted in proximity of the cylinder at the distal end of the tiller. This is particularly innovative since it is exactly opposite to known solutions. This is achieved by using a hinge mechanism adapted to transmit actuation strokes for the valve also with very small pivoting angles of the tiller.

In one embodiment, the member transforming the pivoting movement comprises an arm translating and/or rotating in one or in the opposite direction with respect to a central balance position. Such position advantageously corresponds to a command closing the valve which, for example, is of the monostable type with a stable closed position of the valve corresponding to the central balance position of the arm and/or of the pin driving the valve that can be of any type. In its simplest form, it is a 2-way valve, that is, with a valve member that allows/prevents fluid from passing from one inlet to one outlet. In this case the shutter can be advantageously coupled to the arm such that the maximum opening condition of the valve member occurs when the arm reaches its end-of-stroke in one or in the opposite direction like a piston. The valve member is correspondingly movable in one direction or in the opposite direction to correspondingly open the flow between inlet and outlet from an intermediate closed condition of the valve.

The interposition element is integral with the steering member, for example, is mounted on the steering rod of the motor or of the rudder member, and comprises an appendage coupled by hinge according to a substantially vertical axis to a corresponding end element of the tiller.

The steering tiller in proximity of the interposition element has a perforated appendage such to make a connecting rod/crank mechanism with a corresponding perforated end element of the arm actuating the valve.

A spring return element may be provided that acts between the interposition element and the tiller and/or actuating arm to bring back the tiller in the rest intermediate position with a null pivoting angle without forces exerted by the user. The intermediate position of the tiller advantageously corresponds to the intermediate position of the actuating arm.

Further characteristics are the subject matter of dependent claims.

BRIEF DESCRIPTION OF THE DRAWINGS

These and other characteristics and advantages deriving therefrom will be clearer from the following description of a few embodiments shown in enclosed drawings, in which.

DETAILED DESCRIPTION OF EMBODIMENTS OF THE INVENTION

Figure 1:
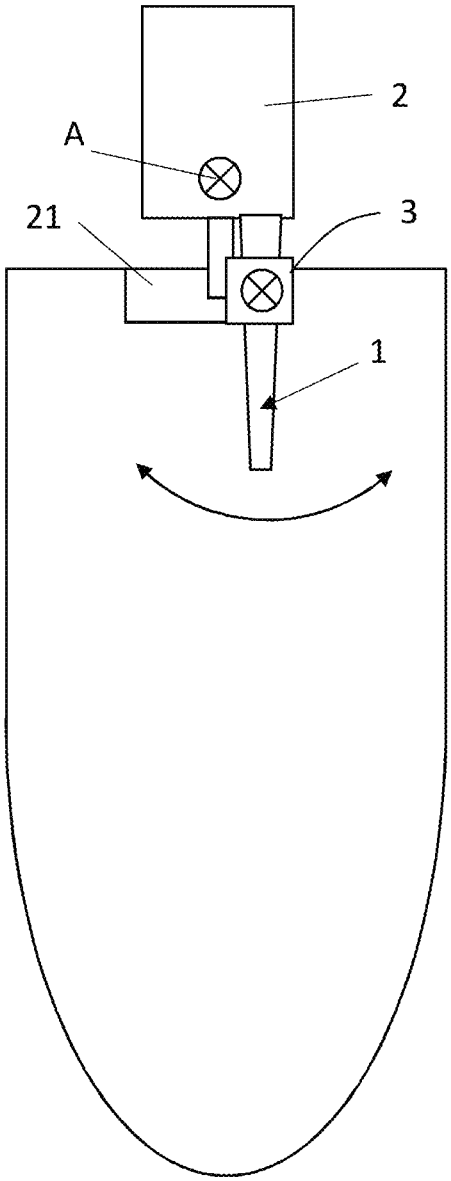
FIG. 1 illustrates schematically a watercraft with a steering control tiller and a system locking the steering rotation according to one embodiment of the invention.

FIG. 1 illustrates schematically a watercraft with an outboard motor 2 fastened to the transom. A steering tiller 1 is fastened to the motor 2, which can be provided with different control members to control different functions of the motor, such as, for example, number of revolutions of the motor, forward direction or idle condition, or the position of the motor relative to the transom.

The steering tiller 1 is integral with the motor 2, which is mounted together with the tiller so as to pivot about a steering axis denoted by A. Means locking the rotation of the motor are denoted by 21 and are controlled by a control member 3.

Figure 2:
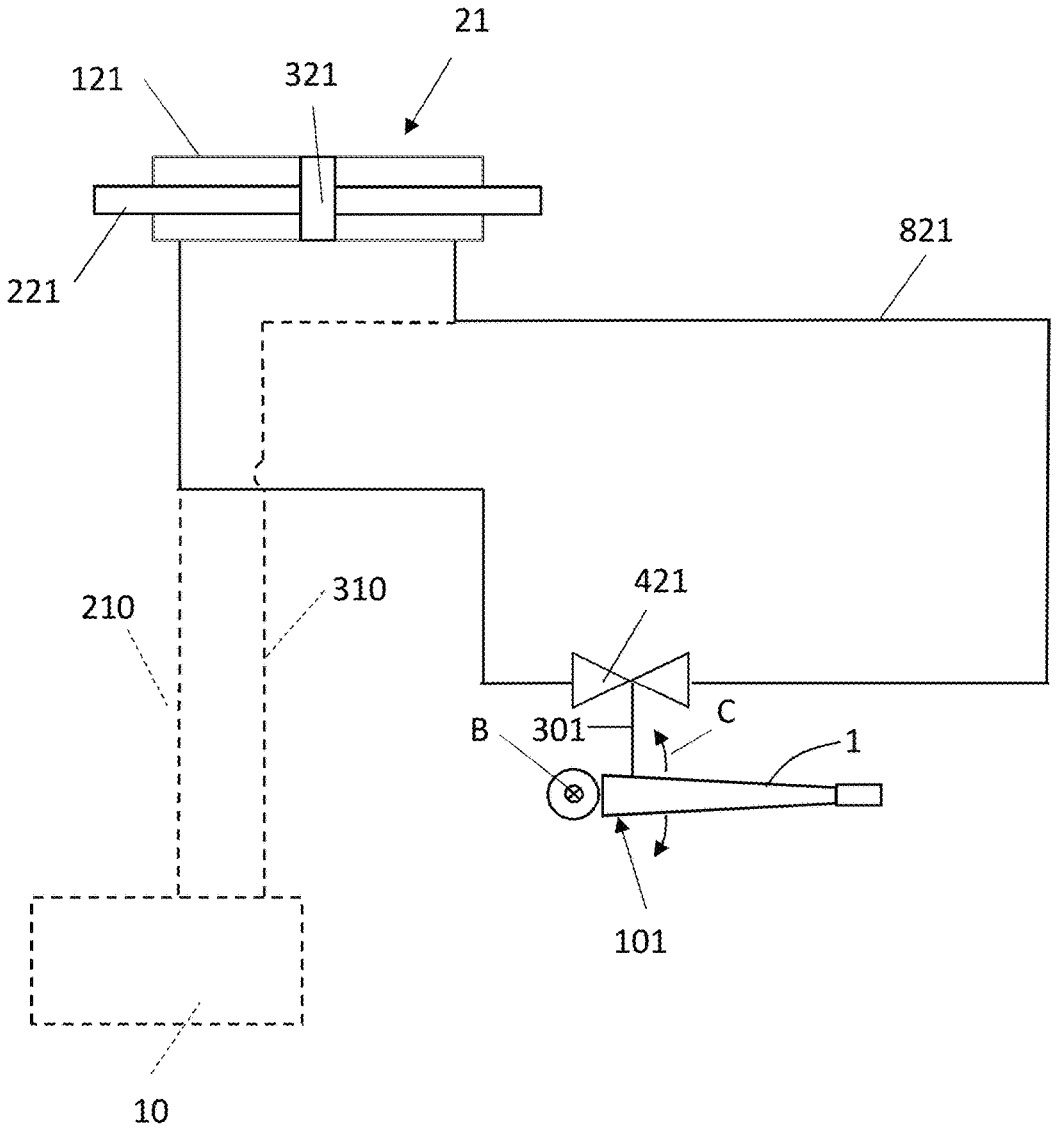
FIG. 2 illustrates an exemplified circuit diagram of the system locking the steering rotation of the preceding figure.
Figure 4:
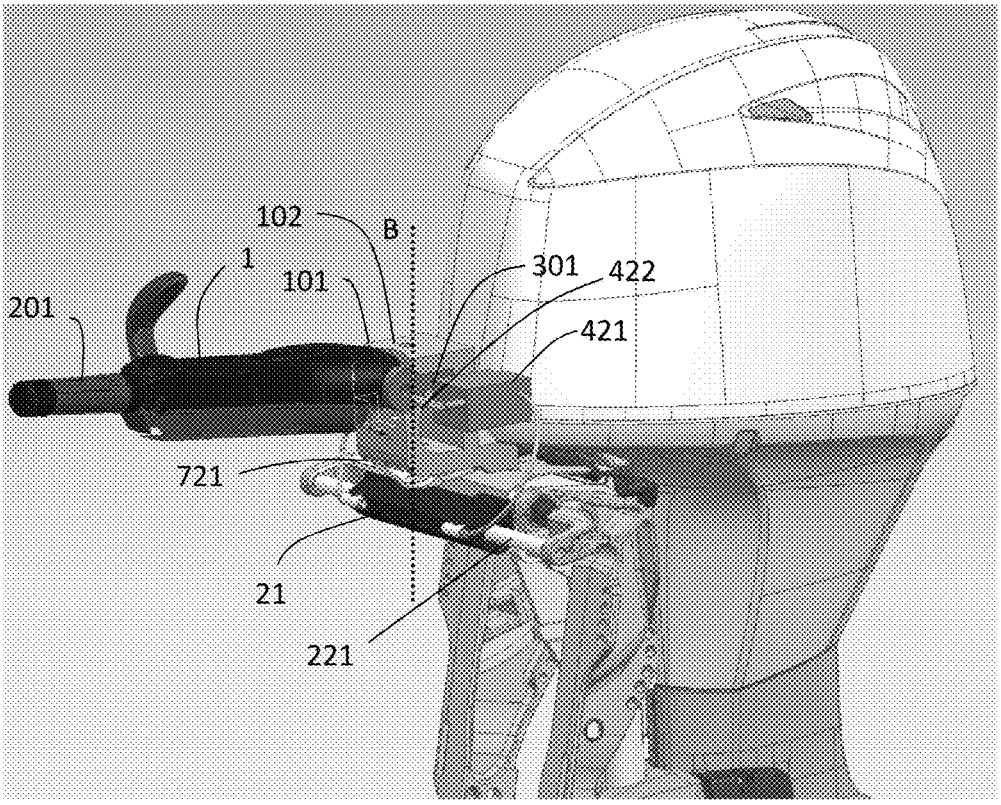
FIG. 4 illustrates an axonometric view of a system according to an embodiment used to control the rotation of an outboard motor.

With reference to the figures and particularly to FIGS. 2 and 4, there is shown an operation diagram of the system locking the steering rotation of the motor. An actuating cylinder 21, with a rod 221 and a piston 321 dividing the cylinder chamber 121 into two separate chambers, is fastened by said rod to the watercraft transom, directly or by means of the member fastening the motor to the watercraft. Thus, a change in the oil in the chambers into one chamber and out from the other chamber of the two chambers respectively causes the cylinder to move along the rod. The cylinder is constrained, for example, to the steering arm of the motor or in the alternative or in combination to a part of the steering tiller 1.

The two chambers of the cylinder are connected with each other by a by-pass circuit 821 where a valve 421 closing/opening the circuit is provided.

Preferably, without any control signal, the valve 421 firmly is in the condition closing the circuit, thus the fluid cannot pass from one to the other chamber and, therefore, the motor is prevented from rotating about axis A.

The tiller 1 has the distal end 101 pivoting about an axis B for example in two opposite directions with respect to a central neutral position as denoted by arrows C.

The pivoting movement of the tiller 1 is used to actuate the valve 421 such that the valve opens when an action urging the tiller 1 in one or in the other steering direction is exerted on the tiller causing, as a first response, the end portion to be pivoted in the urging direction and therefore causing the valve 421 to be opened and the rotation of the motor about axis A to be unlocked by the steering action exerted on the tiller 1 that moves correspondingly to the protraction of the steering urging action thereon.

According to one embodiment the valve 421 advantageously is of the double symmetric actuating stroke type with a pivoting actuation arm 422 moving in one direction and in the opposite direction with respect to a central closed valve position. The valve 421 opens indifferently with the arm 422 moving in one direction or in the opposite direction, for example with configurations of the arm completely in or completely out from the valve seat. The arm 422 in practice acts as a piston that actuates the valve in the opening condition at the top and bottom dead center. Variants are also possible. For example, the actuation stroke may not be straight, but be shaped as an arc of a circumference, or a pair of valves may be mounted symmetrically to the arm such that the pivoting movement thereof in one or the other direction causes one valve to be opened and the other valve to be closed and vice versa.

The pivoting movement of the arm 422 in one or in the opposite direction is caused by a member that converts the rotating motion of the tiller 1 with respect to a vertical axis B substantially parallel to the axis of rotation of the motor A into a reciprocating translation motion. Several solutions are possible among those known to the person skilled in the art. FIG. 1 shows a specific solution by way of example using a connecting rod/crank, cam or crank and slotted link kinematic mechanism. Transmissions having a more direct motion transferring mechanisms and introducing fewer components and, therefore, fewer clearances are possible and are within the available choices to a person skilled in the art among the several possible and known solutions.

Figure 5:
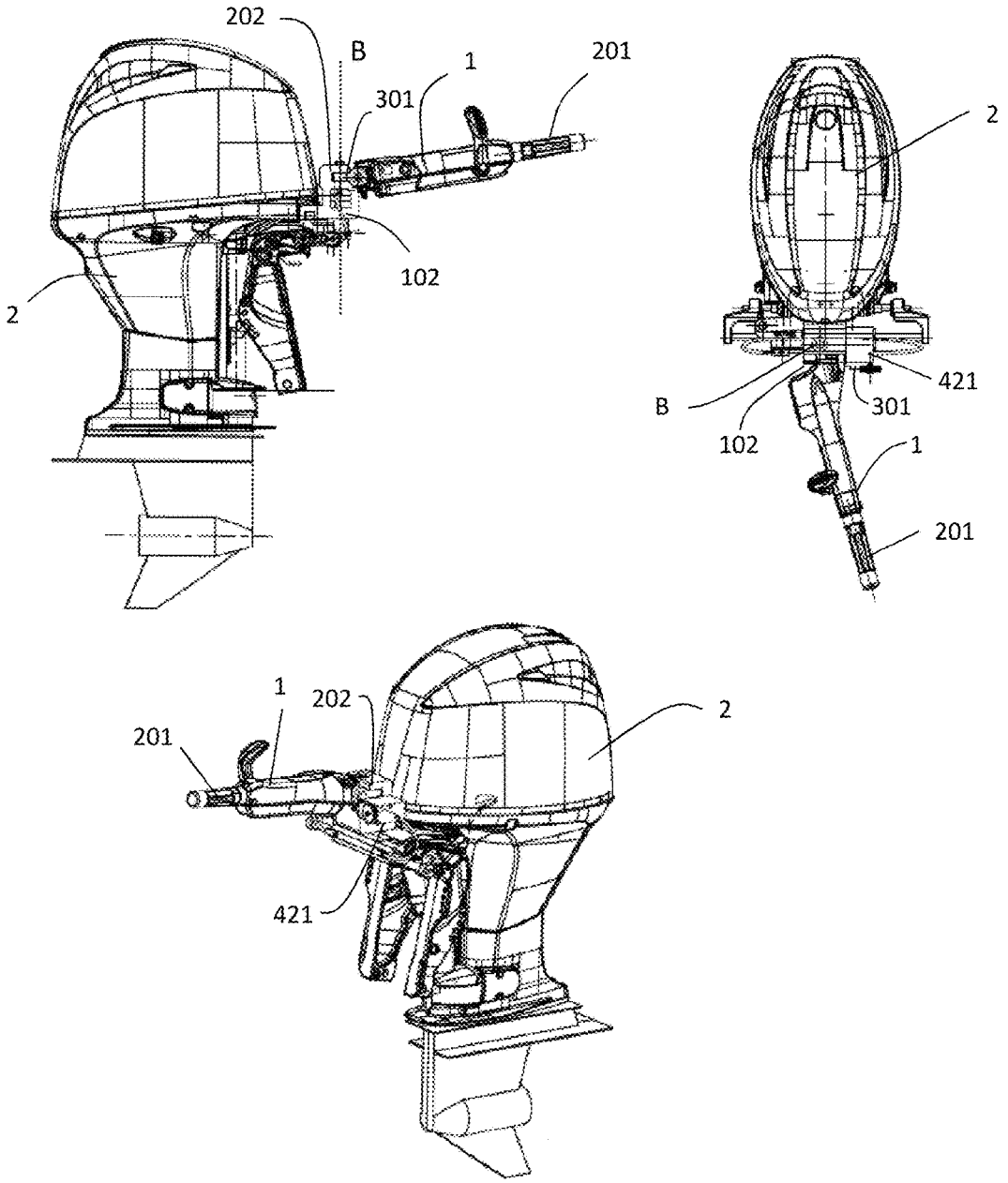
FIG. 5 provides different views of the system of the preceding figure.

In the solution shown in FIGS. 4 and 5, the steering tiller 1 has, in its distal part 101, opposite to the proximal part 201 grasped by the user, a flattened end element 301 intended to be inserted in an element 102 having a reversed G shape with a fork-like upper appendage 202 to make a hinge fit according to vertical axis B.

The G-shaped element 102 is interposed between the steering tiller 1 and the watercraft direction changing member 2, specifically a motor. Thus a disconnection is obtained between the tiller 1 and the motor 2 such that rotations of the tiller corresponds to rotations of the motor only after the end element 301 of the tiller has reached its end-of-stroke in its rotation about a vertical axis B with respect to the interposition element 102.

By hinging the arm 422 of the valve 421 to the end element 301 of the tiller 1 the rotation thereof is converted in the translation of the arm necessary to actuate the valve also in presence of very small angles.

Since the rotation that causes the valve to be actuated is perceived as a vain rotation since it does not involve a corresponding rotation of the motor and therefore a change in direction of the watercraft, by using a double actuating stroke valve with hinged actuation arm, it is possible to contain the pivoting movement of the proximal end also for tillers with a given length.

The valve actuation arm 422 or the end part 301 of the tiller can be advantageously associated to a return spring able to bring back the tiller in its central position corresponding to the central position of the actuation arm, that is to the closed valve configuration, when the user does not act in rotating the tiller in one or in the opposite direction.

In a particular advantageous configuration, the interposition element 102 is directly mounted on the arm 721 of the double acting cylinder 21 such as shown in figures obtaining a very compact system. Obviously it is possible to make the element directly integral with the motor or with a member coupled thereto.

Figure 3:
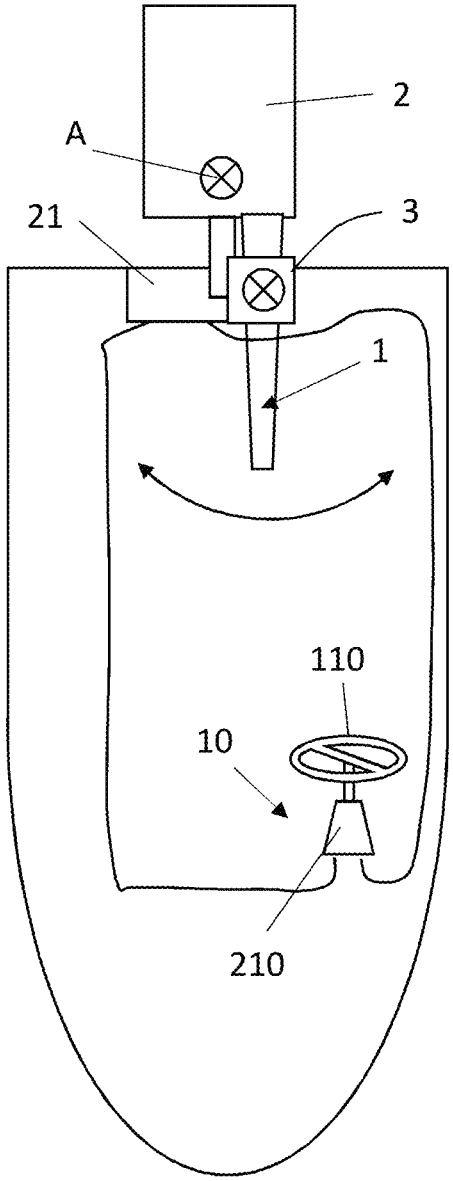
FIG. 3 illustrates schematically an example of a steering control system of a watercraft according to an embodiment of the invention, wherein, in addition to the steering control using steering tiller 1, the steering control can be performed also by a remote station denoted generally by 10.

The system according to the invention is particularly suitable for being used on watercrafts free from remote steering stations, but obviously it can be used also in such situations such as shown by way of example in FIG. 3.

With reference to this figure, the remote steering station 10 can be composed of a conventional hydraulic steering system that provides a steering control member, such as a steering wheel or the like 110, which steering wheel is splined on the shaft driving a pump. The pump is driven by the rotation of the steering wheel and is connected to the two chambers of the cylinder through ducts acting as delivery or return depending on the direction of rotation of the steering wheel 110. Such type of system is known and is widely used in hydraulic steering systems.

Delivery/return ducts 210, 310 are connected to each of the two chambers of the cylinder 121 respectively.

The solution is outlined with dashed lines in FIG. 2.

It is immediately clear that, except for the possible provision of check valves to prevent pressurized oil generated by the remote station 10 from passing in the by-pass circuit, there are no difficulties and no changes or important arrangements are required to connect the remote station.

According to an additional feature, the locking device can be provided in combination with a brake or can be composed of a brake acting between the mobile part and the fixed part of the locking means.

The brake can be of the hydraulic, mechanical, electromechanical, electromagnetic type or the like and can act only for changing the friction of the rotation of the motor or rudder or also to exert the locking action.

For example, in case of a hydraulic system, the brake can be composed of a further valve regulating the fluid flow rate. By regulating the flow rate, the resistance to the displacement of the steering tiller, that is of the rotation of the motor or rudder plate correspondingly changes.

According to an improvement, the locking valve that releases or stops the flow between the cylinder chambers can be provided with an openable and closable bypass duct and that, in the open condition, connects alternatively to the passage through the valve seat the fluid flow passageways. A valve opening and closing the bypass duct can be operated manually or by a servo control alternatively in the condition opening and closing the bypass of the locking valve. Such solution allows the steering arm to be released from the locking system composed of the cylinder, the bypass connecting the two chambers of the cylinder and the locking valve that controls fluid through the bypass. The condition released from the locking system for example is important at low speeds and in maneuvering conditions.

The invention provides also for a variant embodiment wherein, instead of a mechanical transmission for the pivoting movement of the steering arm to the member driving the locking valve, there is provided a hydraulic transmission. In this case, the pivoting movement of the steering arm acts by a control appendage on a hydraulic piston of a cylinder/piston unit sized such to move an amount of hydraulic fluid that directly or indirectly acts on a member actuating the movement of the valve member of the locking valve and which amount of hydraulic fluid is intended to generate a displacement stroke of the member actuating the valve member of the locking valve between the two positions corresponding to open condition and closed condition of the locking valve. Advantageously such displacement occurs in opposition to a spring elastically urging said members correspondingly to an operating condition of the valve member of the locking valve, for example a neutral position or one of the two closed or open positions.

According to a further variant embodiment, the hydraulic fluid instead of acting directly on the member driving the valve member of the locking valve 421 communicates with a further piston dynamically connected to said member driving the valve member of the locking valve. The second piston has a surface in contact with the fluid that can have a size different than the piston connected to the steering tiller, allowing the actuation stroke of the second piston to be changed with respect to the first piston and therefore allowing limited pivoting movements of the tiller to be provided independent from and therefore with no efficacy on the motor steering, while maintaining an actuation stroke of the displacement of the valve member between the open condition and the closed condition of the valve.

Figure 6:
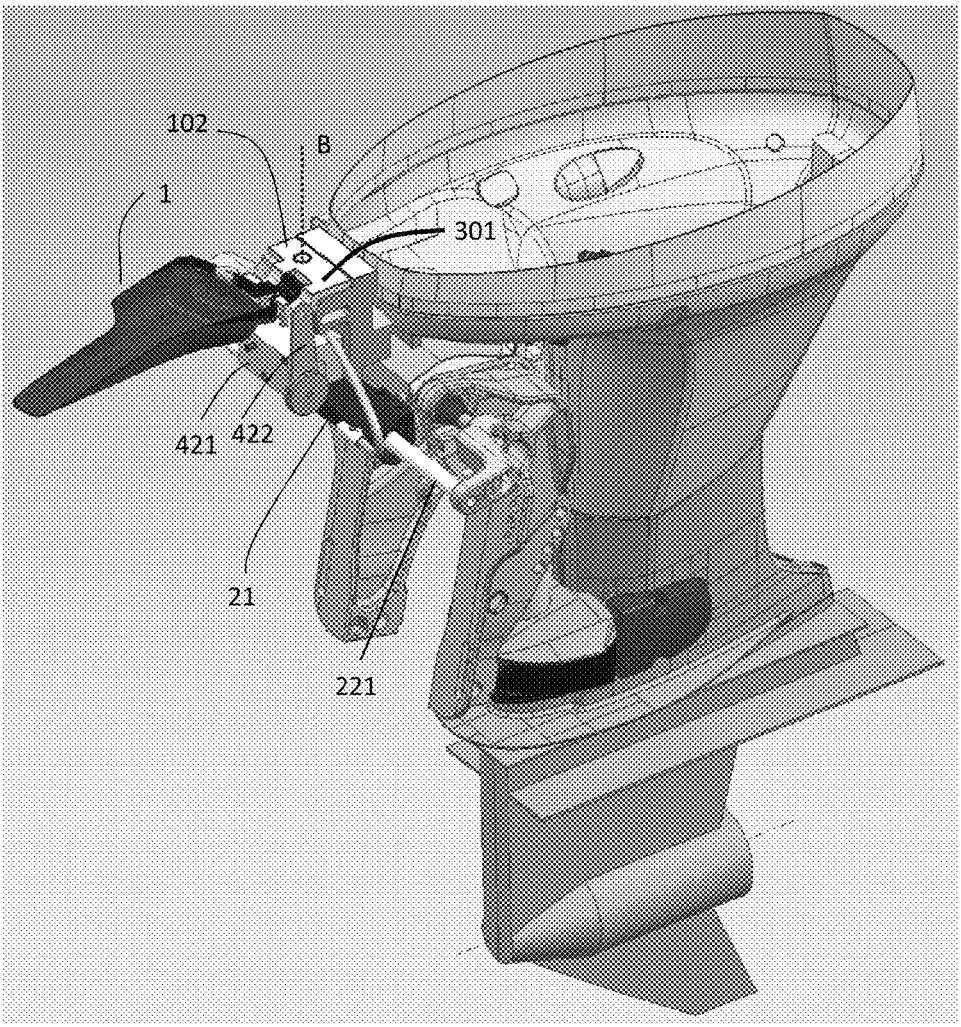
FIG. 6 illustrates an outboard motor with a variant of a system according to the present invention, wherein said system and motor are shown in cross-sections according to a plane perpendicular to the steering axis and coinciding with a plane intermediate to the support of the steering tiller.
Figure 7:
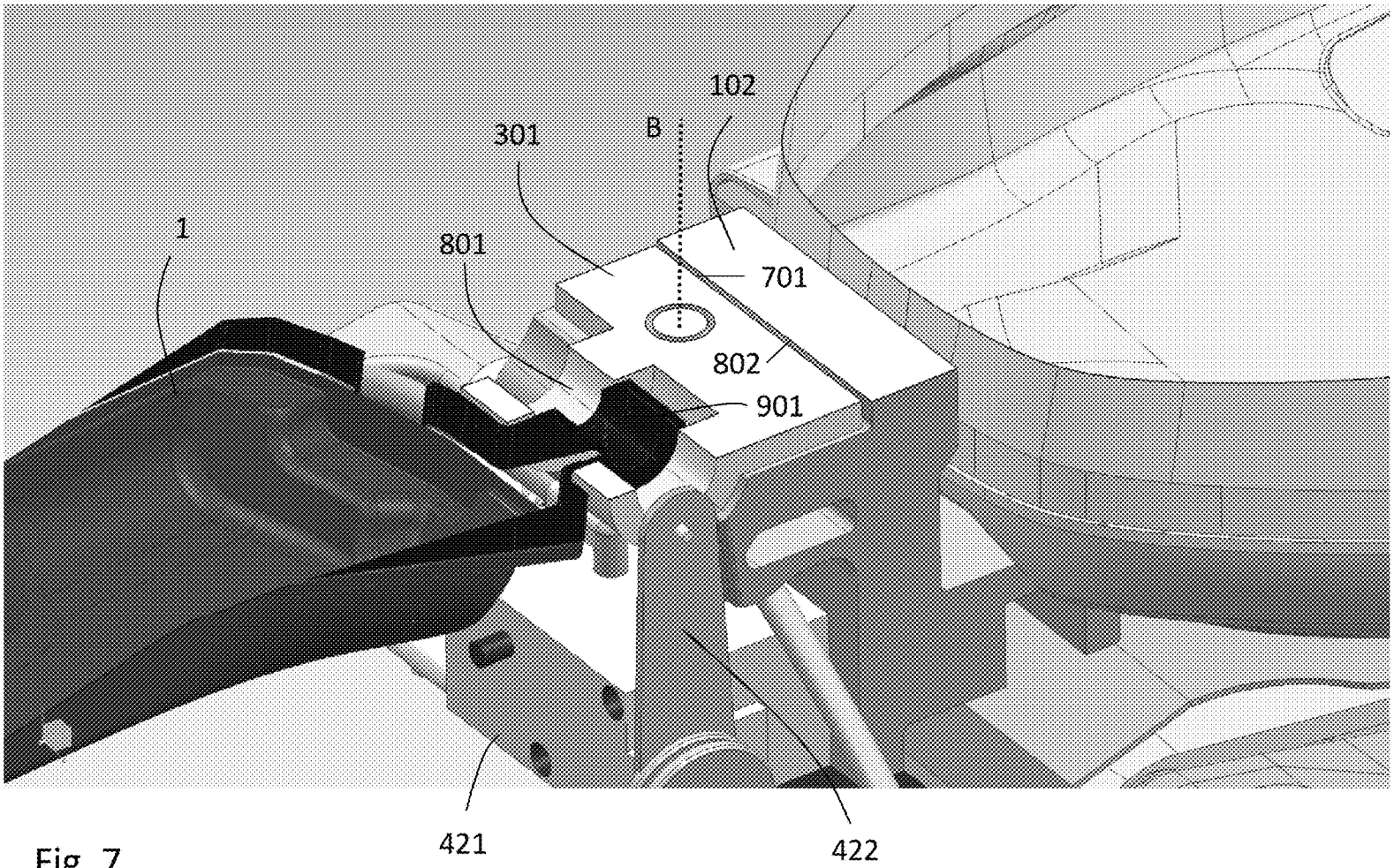
FIG. 7 illustrates an enlarged view of a detail of FIG. 6 as regards the support pivotably fastening the steering tiller to the motor.

FIGS. 6 and 7 show a variant embodiment of the system according to the present invention. Such variant is different mainly as regards the orientation of the actuation arm 422 that connects the element 301 to the member controlling the valve 421.

The support of the tiller 1 is composed of the intermediate element 102 integral to the motor and forming the rotational engagement seat about the pivot axis B of the tiller 1 by the end element 301 of the tiller 1.

As it is clear the end element of the tiller 1 is connected to the arm by a pivotable joint allowing the tiller to angularly displace with respect to the end element in a vertical plane. Such element is of the hinge type with pivoting movement about a horizontal axis that is perpendicular to the steering axis or to the pivot axis B of the tiller 1 and allows the tiller 1 to be raised and lowered.

FIGS. 6 and 7 show the seats 801 and 901 housing the common hinge axis (not visible). As it clear from FIGS. 4 and 5 such solution is common to the previous embodiment and it is directly applied also thereto.

Moreover, as it is clear from FIGS. 6 and 7, the end 102 can follow an angular pivoting movement with a limited size with respect to the element 102 integral to the motor to which it is constrained by the shaft 702 that defines the axis B. The pivoting movement is delimited also by abutment surfaces cooperating with each other denoted by 802 on the element 102 and 701 on the end 301 of the tiller 1. The two surfaces 701 and 802 are parallel to each other and are at a predetermined distance, such that they abut against each other when the element 102 and the end 301 are angularly moved to the right or to the left with respect to a central position where they are parallel with each other as in FIGS. 6 and 7. By such characteristic with the surfaces 701, 802 in the abutment condition the valve 421 is open and allows fluid to pass between the two chambers of the actuator 21, therefore the rotation of the motor about the steering axis is free, and the push for further pivoting to the right or left the tiller 1 is transmitted through the element 102 on the motor causing the tiller to be pulled or pushed in the same pivoting direction.

As it is clear, the distance of the two surfaces 701, 802 with the tiller 1 in the central condition determines the angle of the independent stroke of the tiller 1 with respect to the motor and that is the actuation stroke of the valve 421 that releases the further steering action of the motor through the tiller 1. Such angular pivoting movement can be modified by changing said distance of the surfaces 701 and 802 and it has to be proportioned to the transmission of an actuation stroke of the valve 421 through the mechanical transmission of the arm 422.

The construction of the abutment surfaces 701 and 802 that delimit the pivoting movement of the tiller 1 independent from the motor steering and the transmission of the force of the tiller 1 to the motor during the steering action can be applied to the embodiments of FIGS. 6 and 7 and also to embodiments of FIGS. 4 and 5 and it is one example among the different embodiments the person skilled in the art can choose from.

Figure 8:
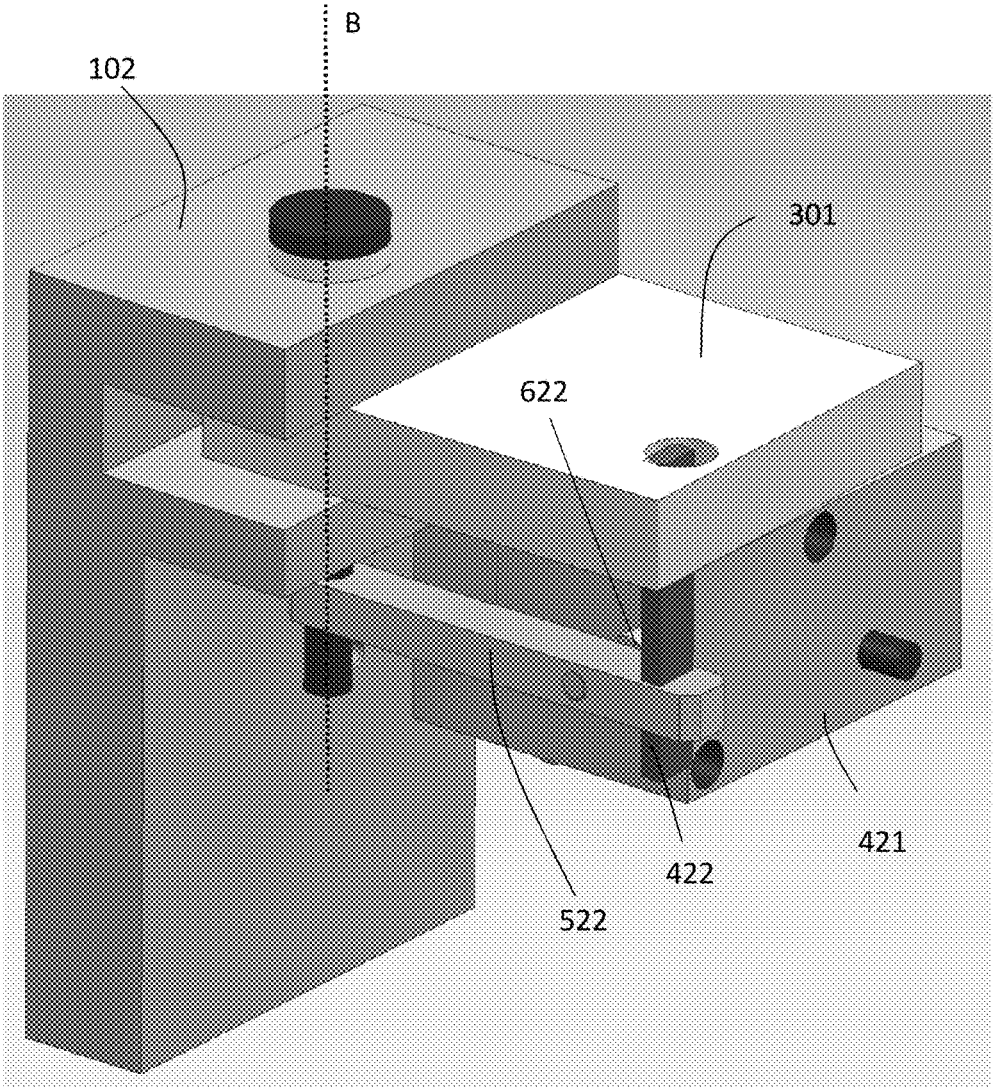
FIG. 8 illustrates schematically an additional variant embodiment of a system according to the invention.

With reference to FIG. 8, in this schematically shown variant the locking valve 421 is arranged fastened to the intermediate element 102 under the articulation seat of the end 301 of the steering tiller 1. The rod 622 actuating the displacement of the valve member is provided oriented towards the tiller 1 and transverse thereto. A control tab denoted by the same reference number 422 used for the arm having the same function in variants of the previous figures protrudes from the end 301 of the tiller 1 or from the tiller in direction of said rod. Such tab can be dynamically connected directly to the control rod 622 of the valve member or can be connected to a further support arm 522 pivotable also about the pivot axis B of the end and of the tiller 1 and that is connected to a free end portion of the tab 422, while the distal end with respect to the tab 422 is rotatably mounted on an extension of the pivot axis of the arm. The tab 422 can be provided as removable and/or adjustable in projection, for example by an engagement of one end thereof in a seat of the end 301 or of the tiller 1. In this case for example the end of the tab can be like a threaded pin engaging into a thread of the seat.

Even if not explicitly shown, to the schematic variant of FIG. 8 it is possible to apply all possible combinations of characteristics and variants provided for the other embodiments, when not in conflict with the characteristics of such embodiment and with suitable adaptation changes.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

The invention claimed is:

1. A steering control system for a watercraft comprising:

a pivoting steering tiller (1) manually operated and operatively connected to a direction changing member (2) acting on or into the water;

a locking device locking the steering tiller in a steering position (21, 121, 221), the device being adapted to be activated for maintaining said steering tiller in a predetermined pivoting position and deactivated for allowing said steering tiller to move in a pivoting position to carry out a change in direction, wherein the locking device is hydraulic and comprises a hydraulic cylinder (21) comprising two chambers separated by a piston (321) having a rod (221) connected thereto, said rod (221) being fastened stationary to a transom of the watercraft and a cylindrical body of said hydraulic cylinder (21) being movable along said rod and being connected to a steering arm of a motor or of a rudder member (721), or vice versa;

a closed circuit (821) for flowing oil between the two chambers of said cylinder, a valve (421) being provided opening and closing said closed circuit, the locking device being activated/deactivated by an actuator (301) that opens/closes the valve opening and closing the closed circuit; and a pivoting fastening support for the steering tiller (1), shaped an interposition element (102) between the steering tiller (1) and the direction changing member (2), the tiller (1) being articulated to the interposition element to pivot about an axis, which is substantially parallel to a steering axis, for a limited angular displacement arc that is a displacement stroke of the steering tiller (1) independent from the pivoting fastening support and from a steering rotation of the motor, a stroke of the motor corresponding to an actuation travel of the valve (421) and the actuator (301) transforming a pivoting movement of the tiller (1) with respect to the interposition element (102) into commands actuating the valve (421).

2. The steering control system according to claim 1, further comprising, between the tiller (1) and the fastening support, members rotationally pulling the motor by pivoting the steering tiller (1) beyond the displacement stroke of said steering tiller (1) with respect to the fastening support, said members being stop elements for the pivoting movement of the steering tiller (1) from the fastening support.

3. The steering control system according to claim 1, wherein the actuator (301) transforming the pivoting movement of the steering tiller (1) is composed, in alternative or in combination, by a transmission of a motion of the steering tiller (1) that is of mechanical, electric, or hydraulic.

4. The steering control system according to claim 1, wherein the actuator comprises a cylinder/piston unit, the piston being dynamically connected to the steering tiller (1)

and moving between two extreme positions by the pivoting movement of the steering tiller (1).

5. The steering control system according to claim 1, wherein the actuator comprises an arm (301) that translates and/or rotates in a same direction or an opposite direction with respect to a central balancing position.

6. The steering control system according to claim 5, wherein the central balancing position of the arm (301) corresponds to a command closing the valve (421).

7. The steering control system according to claim 6, wherein the valve (421) is of monostable, the arm (301) of the actuator being coupled to the valve (421) such that a stable closing position of the valve corresponds to the central balancing position of the arm.

8. The steering control system according to claim 7, wherein the valve (421) comprises a valve member that allows or prevents the oil from passing from an inlet and an outlet, said valve member being movable in a first direction or in an opposite direction such to correspondingly open A flow between the inlet and the outlet from an intermediate closing condition, and wherein the valve member is coupled with the arm (301) such that a maximum open condition of the valve member occurs when the arm (301) reaches its stop element in the first direction or in the opposite direction.

9. The steering control system according to claim 1, wherein the interposition element (102) is integral with the direction changing member and comprises an appendage (202) that is hingedly coupled according to a substantially vertical axis (B) with a corresponding end element (301) of the steering tiller (1).

10. The steering control system according to claim 9, wherein the appendage (202) of the interposition element (102) has a shape of a U-shaped arm that receives a flattened appendage of the steering tiller by a coupling pin.

11. The steering control system according to claim 1, wherein the interposition element (102) is mounted on a steering arm of the motor or of the direction changing member (2).

12. The steering control system according to claim 6, wherein the steering tiller (1), in proximity of the interposition element (102), has a perforated appendage such to form a connecting rod or crank coupling with a corresponding perforated end element of the arm actuating the valve.

13. The steering control system according to claim 1, further comprising a spring return element acting between the interposition element and one or both of the steering tiller and/or actuator such to bring back the steering tiller in an intermediate idle position with a null pivoting angle in case of no efforts exerted by a user, said intermediate position of the tiller corresponding to an intermediate position of the actuator.

14. The steering control system according to claim 8, wherein the valve (421) opening and closing a bypass of the hydraulic cylinder is provided with a by-pass duct of the valve member connecting together the inlet and outlet thereof, said by-pass duct of the valve member being openable and closable by a manually operated valve.

* * * * *